US006742208B2

(12) United States Patent
Broker

(10) Patent No.: US 6,742,208 B2
(45) Date of Patent: Jun. 1, 2004

(54) CLOTHES WASHING MACHINE INCORPORATING NOISE REDUCTION SYSTEM

(75) Inventor: John F. Broker, Colfax, IA (US)

(73) Assignee: Maytag Corporation, Newton, IA (US)

( * ) Notice: Subject to any disclaimer, the term of this patent is extended or adjusted under 35 U.S.C. 154(b) by 223 days.

(21) Appl. No.: 09/935,706

(22) Filed: Aug. 24, 2001

(65) Prior Publication Data

US 2003/0037382 A1 Feb. 27, 2003

(51) Int. Cl.[7] ..... D06F 37/24

(52) U.S. Cl. ..... 8/158; 8/159; 68/12.06; 68/12.16

(58) Field of Search ..... 8/158, 159; 68/12.01, 68/12.02, 12.06, 12.16

(56) References Cited

U.S. PATENT DOCUMENTS

| | | | | |
|---|---|---|---|---|
| 2,021,330 | A | * | 11/1935 | Ross et al. |
| 2,348,922 | A | * | 5/1944 | Pekar |
| 2,442,308 | A | * | 5/1948 | Mererdith et al. |
| 3,270,533 | A | * | 9/1966 | Brenner et al. |
| 4,869,233 | A | | 9/1989 | Stulen et al. |
| 4,991,247 | A | * | 2/1991 | Castwall et al. |
| 5,226,604 | A | * | 7/1993 | Seiffert et al. |
| 5,272,892 | A | | 12/1993 | Janutka et al. |
| 5,287,884 | A | * | 2/1994 | Cohen |
| 5,409,037 | A | | 4/1995 | Wheeler et al. |
| 5,515,029 | A | | 5/1996 | Zhevelev et al. |
| 5,681,401 | A | | 10/1997 | Gardner et al. |
| 5,720,066 | A | | 2/1998 | Kim |
| 5,755,118 | A | * | 5/1998 | Woo |
| 5,804,726 | A | * | 9/1998 | Geib et al. |
| 5,828,304 | A | | 10/1998 | Mowday |
| 6,047,428 | A | | 4/2000 | Min |
| 6,057,996 | A | * | 5/2000 | Kim |
| 6,173,060 | B1 | * | 1/2001 | Huang |
| 6,178,821 | B1 | * | 1/2001 | Savkar et al. |
| 6,317,051 | B1 | * | 11/2001 | Cohen |

FOREIGN PATENT DOCUMENTS

| | | | |
|---|---|---|---|
| JP | 3-193091 | * | 8/1991 |
| JP | 4-9189 | * | 1/1992 |
| JP | 4-325193 | | 11/1992 |
| JP | 5-309193 | * | 11/1993 |
| JP | 9-32006 | * | 12/1997 |

* cited by examiner

*Primary Examiner*—Frankie L. Stinson
(74) *Attorney, Agent, or Firm*—Diederiks & Whitelaw, PLC

(57) ABSTRACT

A washing machine is provided with a noise reduction and control system which can sense out of balance and pump starvation conditions. More specifically, a microphone is used in connection with an electronic controller to sense an unbalance or pump starvation condition and alter a washing operation of the machine to counteract the unbalance or pump starvation condition. Additionally, the microphone and controller can respond to voice commands to establish the washing operation for the washing machine.

14 Claims, 3 Drawing Sheets

CLOTHES WASHING MACHINE INCORPORATING NOISE REDUCTION SYSTEM

BACKGROUND OF THE INVENTION

1. Field of the Invention

The present invention pertains to the art of clothes washing machines and, more particularly, to a noise reduction system for a washing machine.

2. Discussion of the Prior Art

In a clothes washing machine, it is not uncommon for a fair amount of noise to be developed during normal operation. For example, when a washing machine tub is rotated at a relatively high speed during an extraction phase of an overall washing cycle, an unbalance condition can cause considerable vibration and noise. Excessive vibrations can be detrimental to the continued reliability of the machine. In an attempt to avoid this problem, it is known in the art to provide a vibration detection system for sensing an actual or incipient unbalance condition and for altering the operation of the machine when a predetermined threshold is reached. Typically, known systems function to either reduce the rotational speed of the clothes tub or entirely shut down the machine to counteract an unbalance condition. In the art, various different vibration detection systems have been employed. For instance, it has been known to employ switches, particularly micro-switches, which are closed when excessive vibrations are encountered. Activation of the switches is relayed to a controller for altering the operational state of the machine. Other known systems provide rather complicated electronic sensing systems to perform a corresponding function.

Another major source of noise is caused by a pump typically used to drain water from the washing machine tub. The noise caused by the pump is particularly loud when the pump is starving for water during a spin out or extraction mode. Essentially the water is forced back and forth in a drain hose during pump starvation, thereby creating objectionable noises. While attempts have been made to address the problem of pump starvation in the area of dishwashers, significantly less effort has been applied in the area of clothes washing machines. In any event, there exists a need in dealing with noise produced by an unbalanced condition, pump starvation, or generally optimizing the noise level in a clothes washing machine.

Finally, it should be noted that prior art washing machines have typically been controlled by using either buttons or knobs to set desired washing cycle parameters, such as the desired fill level, load size, wash and rinse temperatures, along with washing operations, such as gentle, normal or light cycles typically based on the particular fabrics being washed. Using such buttons and knobs can be cumbersome, especially when one's hands are full of clothing that need to be washed. Therefore, there exists a need in the art for a noise control system for washing machines which can sense and reduce noise caused by vibration or unbalance, noise caused by pump starvation and additionally, provide for an easy way to control the various washing operations of the washing machine.

SUMMARY OF THE INVENTION

A noise reduction system for a washing machine constructed in accordance with the present invention is used to control noises caused from various sources, such as excessive vibration and pump starvation, in a reliable, accurate and cost effective manner. More specifically, the present invention is directed to a noise reduction system for a washing machine, particularly a horizontal axis washing machine, which can sense excessive vibration and pump starvation through the use of a microphone. In accordance with the invention, the noise reduction system can sense actual or incipient unbalance conditions with the microphone. Once an unbalance or excessive vibration condition is sensed, a controller may alter the operation of the machine to counteract system imbalances. For instance, the system can either be stopped for a short amount of time to rebalance the clothing within the washing machine tub or alternatively, stopped altogether.

In a similar manner, the noise generated in an early stage of pump starvation can be audibly sensed. Based on the microphone inputs, the washing machine controller can evaluate the starvation condition and turn the drain pump off. Additionally, the microphone can be used to audibly sense when the water level in the tub is high enough to hit the washing machine tub or spinner, at which point the controller turns the drain pump on again.

An additional use of the microphone in a preferred embodiment of the invention is to optimize the noise level of the washing machine during spinning. The speed of the washing machine can be varied and noises generated at each speed are recorded to create a noise curve. Once a valley or minimum point is found in the noise curve, such speeds, which correspond to operational states of low noise, can then be used for future operations. Additionally, vibration itself can be correspondingly limited at the same time.

According to yet a further aspect of the invention, the microphone is connected to the controller of the washing machine in such a way as to allow the machine to respond to voice commands. Essentially, all commands that were previously given by input from either typical knobs, buttons or LCD panels may now be entered into the machine using simple voice commands, thus providing an efficient way to control the overall washing machine.

Based on the above, it should be readily apparent that the invention provides for a relatively simple, inexpensive noise reduction system which addresses the problems caused by vibration, pump starvation and other general noises found in a washing machine and, additionally, provides an efficient way of controlling the machine to optimize operational speeds and to simplify programming. In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE PREFERRED EMBODIMENT

Figure 1:
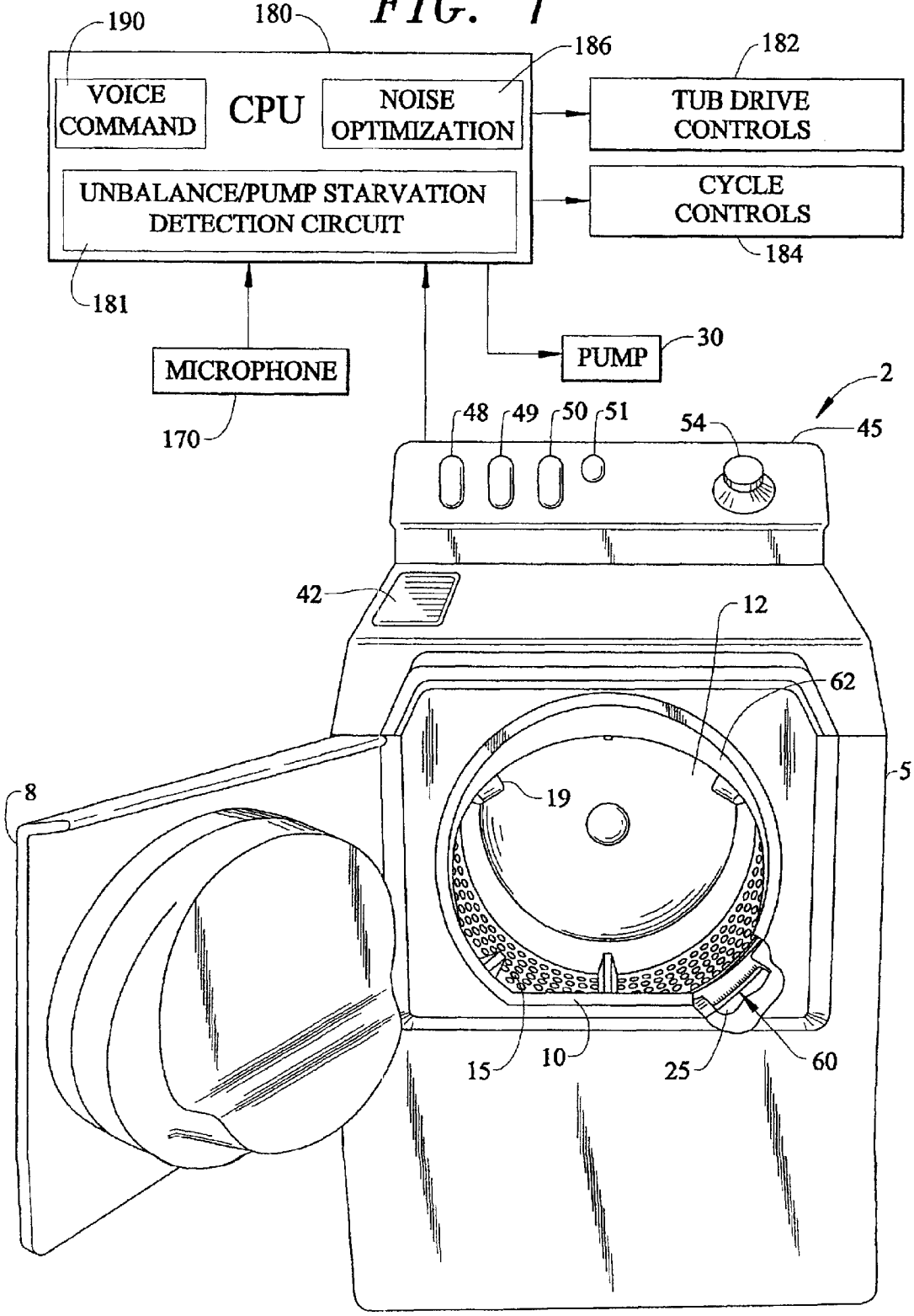
FIG. 1 is a partially cut away, perspective view of a washing machine incorporating a noise reduction system constructed in accordance with the present invention.

With initial reference to FIG. 1, an automatic horizontal axis washing machine incorporating the noise reduction system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

Figure 3:
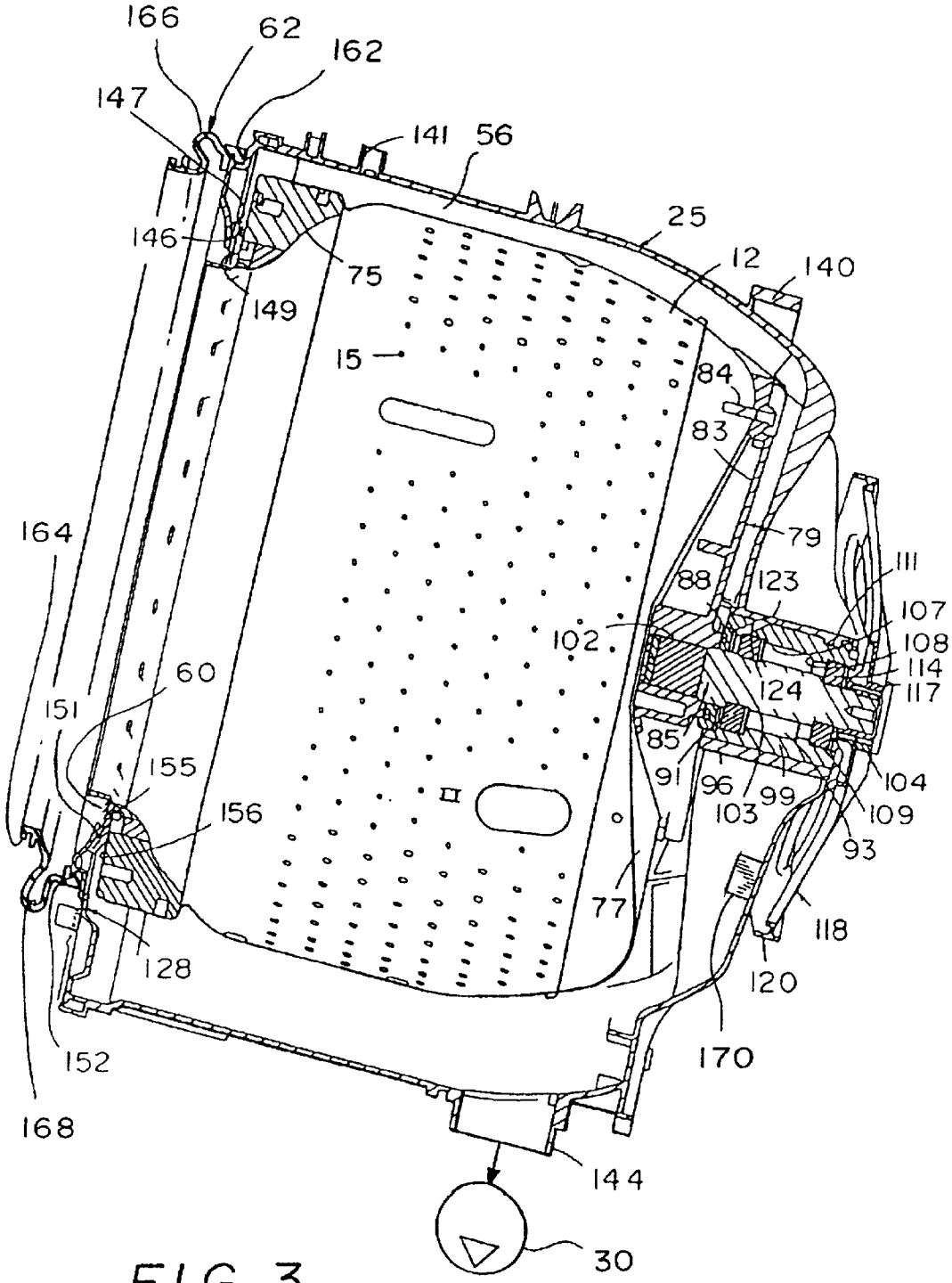
FIG. 3 is a cross-sectional view of the internal components of the washing machine of FIG. 2 in an assembled state.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. Although not shown, a motor, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing fluid supplied within inner tub 12. Given that inner tub 12 is provided with at least the plurality of holes 15, the water or water/detergent can flow between the inner and outer tubs 12 and 25. A pumping system (not fully shown) is provided to control the level of washing fluid within machine 2, with one pump 30 particularly controlling the timed draining of the fluid from the outer tub 25.

The general manner in which the automatic washing machine 2 of FIG. 1 operates is well known in the art and is not considered an aspect of the present invention. However, for the sake of completeness, the main structure and basic operation of automatic washing machine 2 will be briefly described. As shown, automatic washing machine 2 includes an upper cover 42 that provides access to an area for adding detergent, softeners and the like. In addition, in one form of the invention, an upper control panel 45, including various selector buttons 48–51 and a control knob 54, is provided for manually establishing a desired washing operation in a manner known in the art.

Figure 2:
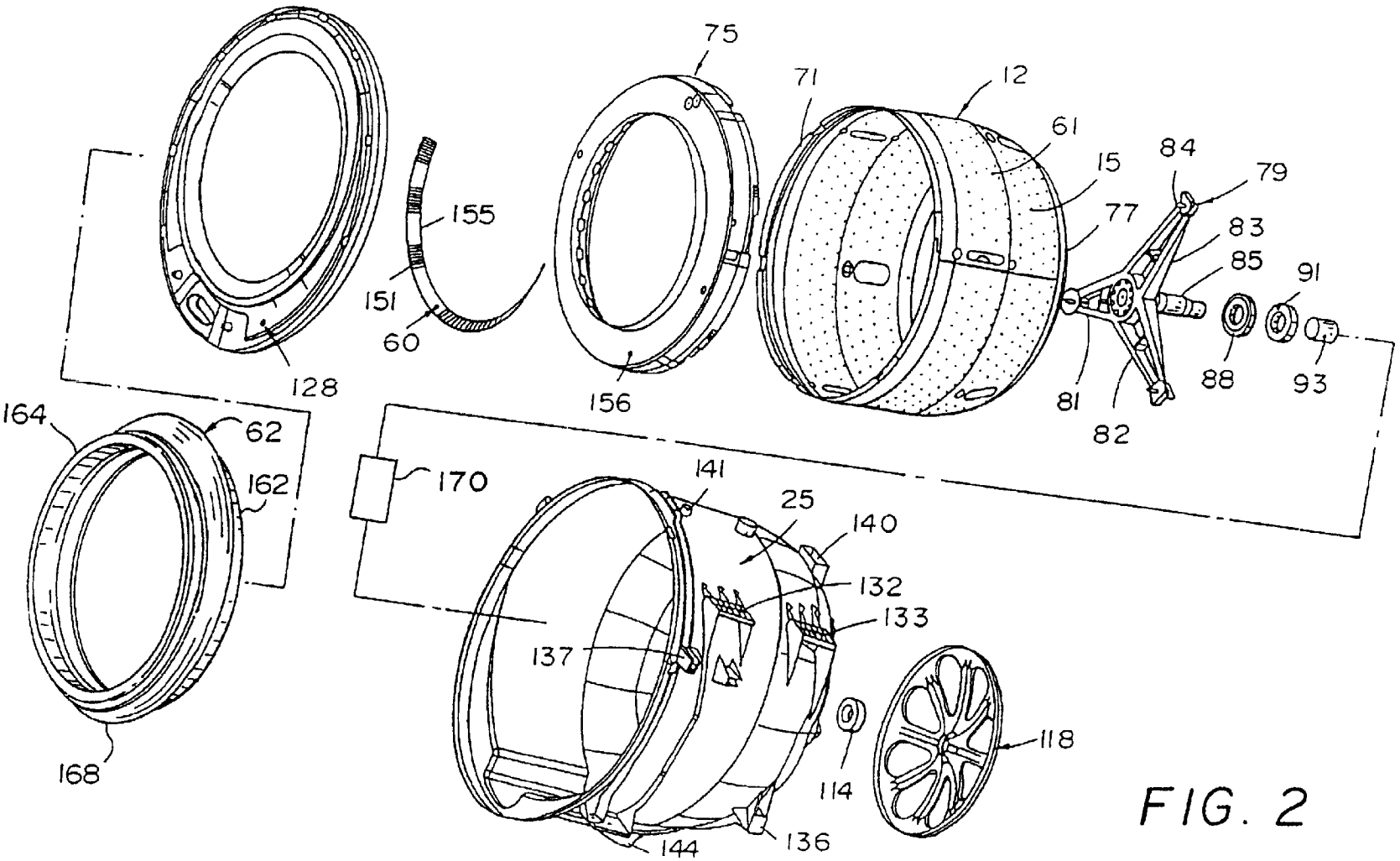
FIG. 2 is an exploded view of the various internal components of the washing machine of FIG. 1.

As best seen in FIGS. 2 and 3, in order to allow inner tub 12 to freely rotate within outer tub 25 during a given washing operation, inner tub 12 is spaced concentrically within outer tub 25. This spacing establishes an annular gap 56 between the inner and outer tubs 12 and 25. As will be discussed fully below, an axial gap is also created at the open frontal portions of inner and outer tubs 12 and 25. During operation of washing machine 2, the washing fluid can flow through gap 56 from inner tub 12 into outer tub 25. In addition, small objects can also flow into the outer tub 25 through the axial gap. Unfortunately, it has been found in the past that some objects flowing through the axial gap can end up clogging or otherwise disrupting the normal operation of the pumping system, thereby leading to the need for machine repairs. In order to remedy this situation, it has been heretofore proposed to incorporate a flexible sealing device, generally indicated at 60 in FIGS. 1 and 3, which functions to bridge this gap between inner and outer tubs 12 and 25 to prevent such objects from flowing into the outer tub 25. Further provided as part of washing machine 2, in a manner known in the art, is a sealing boot 62 which extends generally between outer tub 25 and a frontal panel portion (not separately labeled) of cabinet shell 5. Reference now will be made to FIGS. 2 and 3 in describing the preferred mounting of inner tub 12 within outer tub 25 and the arrangement of both sealing device 60 and sealing boot 62 as the tumble cycle feature of the present invention is related to the presence of one or more of these structural elements.

Inner tub 12 has an annular side wall 61 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to a belt (not shown) driven in a controlled fashion by the reversible motor mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above. Furthermore, outer tub 25 is formed with a drain port 144 which is adapted to be connected to a pump (not shown) for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25. With this fluid flow, other items including buttons, hair pins and the like inadvertently placed in inner tub 12 with the clothes to be washed, can get into outer tub 25. Typically, the pump associated with drain port 144 is capable of managing certain objects without any problem. However, depending upon the size and number of the objects, the pump may not be able to handle the objects, whereby the pump will clog or at least the normal operation thereof will be disrupted.

Because of this problem, the flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed sealed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a lower trough 168.

Until this point, the basic structure of washing machine 2 as described above is known in the art and has been described both for the sake of completeness and to establish the need and advantages of the noise reduction system of the present invention which will now be described in detail. Structurally, the noise reduction system of the instant invention essentially comprises a microphone 170 which may be mounted essentially anywhere within washing machine 2. As shown in FIG. 3, microphone 170 is mounted on outer tub 25 opposite back wall 77 of inner tub 12. Microphone 170 is connected through a wire (not shown) to an electronic controller or CPU system 180. In general, microphone 170 constitutes an acoustic/electric transducer that produces an electric signal in response to sensed acoustic energy. In particular, the acoustic energy generated by either an unbalance of rotating inner tub 12, sound made by starvation of pump 30 or just generally ambient background noises produced during operation of the washing machine 2 is detected by microphone 170. For example, microphone 170 can be constituted by a Panasonic model WM-54BT electric condenser microphone cartridge.

Based on signals received from microphone 170 and analyzed by CPU 180, an unbalance or vibration condition can be determined by unbalance/pump starvation detection circuit 181. In accordance with the invention, the presence of an unbalance condition is counteracted by reducing the rate at which inner tub 12 is being driven through tub drive controls 182 and/or altering a preset operating cycle of the washing machine 2 through cycle controls 184. For instance, if an unbalance condition is detected during an extraction phase of washing machine 2, the rotational speed imparted to inner tub 12 is preferably, initially reduced. If this alteration does not alleviate the excessive balance condition, the operating cycle of washing machine 2 is then terminated through cycle controls 184. Alternatively, cycle controls 184 can simply activate some type of audible and/or visual alarm so that the user can take appropriate action.

It should be noted that microphone 170 and CPU 180 and, more specifically, unbalance/pump starvation circuit 181 can also detect characteristic electrical signals which generally indicate that drain pump 30 is starving during, for example, water spin out. While unbalance condition noises are typically caused by cabinet hits from rotating inner tub 12 and other general vibrations, a starving pump causes noise from lack of water in the pump and the forcing of water back and forth into a drain hose. In accordance with the invention, CPU 180 detects signals from microphone 170 indicative of pump noises which are objectionably high and indicative of classic pump starving conditions. Once CPU 180 senses that microphone 170 is conveying characteristic signals of a starving condition for pump 30, cycle controls 184 are preferably used to turn pump 30 off to avoid the pump starvation condition. Furthermore, when CPU 180 determines that the water level may be high enough to hit inner tub 12 based on signals from microphone 170, cycle controls 184 function to turn drain pump 30 on again.

In the most preferred embodiment, microphone 170 is used in combination with a noise optimization circuit 186 to detect general background noise when basket 12 is spinning. The idea here is to optimize the noise level so as to be least objectionable to a consumer. Essentially, the speed of inner tub 12 is varied until a valley is found in a generated noise curve by noise optimization circuit 186. This determined optimum speed is then used during subsequent washing operations. A similar method of finding optimal rotation of a tub to keep a washing machine vibration (rather than noise) at a minimum can be found in U.S. Pat. No. 5,930,855 which is assigned to the assignee of the present invention and incorporated herein by reference.

Another aspect of the present invention is to utilize microphone 170 to allow washing machine 2 to respond to voice commands. The actual voice recognition software stored in CPU 180 is commonly available and forms no part of this invention. Here, microphone 170 is used in combination with a washing machine voice command circuit 190 to establish cycle settings to washing machine 2. Specifically, a consumer need only indicate by voice command desired cycle parameters, i.e., to use voice commands to effectively input the exact same information to washing machine controller 180 that could be entered through buttons 48–50, dial 54 or inputted through an LCD touch screen. Of course, in this case, microphone 170 would be mounted in such a way so as to easily detect the voice of the consumer. At this point, it should be recognized that more than one microphone can be used to perform the multiple functions described above.

As can be seen from the above description, the present invention provides a simple, inexpensive noise reduction system which addresses problems caused by vibration, pump starvation and other general noises found in a washing machine. Additionally, the preferred embodiment provides an efficient way to control washing machine 2 and optimize operational speeds to reduce noise and, additionally, by using voice control to simplify programming of washing machine 2. In any event, although a preferred embodiment of the invention has been described, it should be understood that various changes and/or modifications could be made to the invention without departing from the spirit thereof. Instead, the invention is only intended to be limited by the scope of the following claims.

I claim:

1. A washing machine for laundering articles of clothing comprising:

a cabinet shell;

an outer tub mounted within the cabinet shell;

an inner tub mounted within the outer tub for rotation during predetermined intervals in an overall clothes washing operation; and a noise reduction system for the washing machine, said noise reduction system including a microphone mounted on the outer tub for audibly sensing at least one of unbalance and pump starving conditions, and an electronic controller for altering the washing operation based on signals received from the microphone.

2. The washing machine according to claim 1, wherein said inner tub is mounted for rotation about a substantially horizontal axis.

3. The washing machine according to claim 1, wherein the controller is adapted to detect a microphone signal corresponding to sensing noise caused by an unbalanced condition.

4. The washing machine according to claim 1, wherein said electronic controller further comprises:

means for varying the rotational speed of the inner tub over a range of speeds; and means for determining which speeds in the range of speeds results in an optimum level of noise.

5. A washing machine for laundering articles of clothing comprising:

a cabinet shell;

an outer tub mounted within the cabinet shell;

an inner tub mounted within the outer tub for rotation during predetermined intervals in an overall clothes washing operation;

a pump; and a noise reduction system for the washing machine, said noise reduction system including a microphone for audibly sensing pump starving conditions, and an electronic controller for altering the washing operation based on signals received from the microphone, wherein the controller is adapted to detect a microphone signal corresponding to sensing noise caused by starvation of the pump.

6. The washing machine according to claim 5, wherein said noise reduction system further comprises means for turning said pump off upon sensing pump starving conditions and means for turning said pump on upon sensing that the inner tub is contacting water collected in the outer tub.

7. A washing machine for laundering articles of clothing comprising:

a cabinet shell;

an outer tub mounted within the cabinet shell;

an inner tub mounted within the outer tub for rotation during predetermined intervals in an overall clothes washing operation;

a noise reduction system for the washing machine, said noise reduction system including a microphone for audibly sensing at least one of unbalance and pump starving conditions, and an electronic controller for altering the washing operation based on signals received from the microphone; and a control system for establishing the washing operation for the washing machine based on voice commands sensed by the microphone.

8. A method of controlling a washing operation of a clothes washing machine including an outer tub, a rotatable inner tub and at least one pump comprising:

using a microphone mounted on the outer tub to sense noise during operation of the washing machine;

providing signals to an electronic controller corresponding to the sensed noise; and altering the washing operation of the washing machine through an electronic controller based on the sensed noise.

9. The method according to claim 8, further comprising:

determining an out of balance condition from the signals provided to the controller from the microphone.

10. The method according to claim 8, further comprising:

varying a rotational speed of the tub over a range of speeds to determine a speed which exhibits optimum noise level as sensed by the microphone.

11. A method of controlling a washing operation of a clothes washing machine including a rotatable tub and at least one pump comprising:

using a microphone to sense noise during operation of the washing machine;

providing signals to an electronic controller corresponding to the sensed noise;

sensing a starvation condition of the at least one pump from the signals provided to the controller from the microphone; and altering the washing operation of the washing machine through an electronic controller based on the sensed noise.

12. The method according to claim 11, further comprising:

stopping the pump upon sensing the starvation condition.

13. The method according to claim 12, further comprising:

sensing that fluid in the washing machine is contacting the rotatable tub; and restarting the pump when the fluid is contacting the rotatable tub.

14. A method of controlling a washing operation of a clothes washing machine including a rotatable tub and at least one puma comprising:

establishing the washing operation based on voice commands sensed by a microphone;

using the microphone to sense noise during operation of the washing machine;

providing signals to an electronic controller corresponding to the sensed noise; and altering the washing operation of the washing machine through an electronic controller based on the sensed noise.

* * * * *